US005800268A

United States Patent [19]

Molnick

[11] Patent Number: 5,800,268

[45] Date of Patent: Sep. 1, 1998

[54] METHOD OF PARTICIPATING IN A LIVE CASINO GAME FROM A REMOTE LOCATION

[76] Inventor: Melvin Molnick, 229 W. Foster Ave., Henderson, Nev. 89015

[21] Appl. No.: 546,355

[22] Filed: Oct. 20, 1995

[51] Int. Cl.[6] ..... A63F 9/22

[52] U.S. Cl. ..... 463/40; 463/12; 902/23

[58] Field of Search ..... 463/40, 41, 42, 463/16, 12; 273/138 A; 364/412; 902/23

[56] References Cited

U.S. PATENT DOCUMENTS

| | | | |
|---|---|---|---|
| 3,810,627 | 5/1974 | Levy | 463/16 X |
| 3,909,002 | 9/1975 | Levy . | |
| 4,339,798 | 7/1982 | Hedges et al. | 364/412 |
| 4,467,424 | 8/1984 | Hedges et al. . | |
| 4,592,546 | 6/1986 | Fascenda et al. . | |
| 4,652,998 | 3/1987 | Koza et al. | 364/412 |
| 4,669,730 | 6/1987 | Small . | |
| 4,745,468 | 5/1988 | Von Kohorn | 463/40 X |
| 4,760,527 | 7/1988 | Sidley | 463/42 X |
| 4,799,683 | 1/1989 | Bruner, Jr. . | |
| 4,815,741 | 3/1989 | Small . | |
| 4,882,473 | 11/1989 | Bergeron et al. . | |
| 5,038,022 | 8/1991 | Lucero . | |
| 5,073,931 | 12/1991 | Audebert et al. | 463/40 X |
| 5,083,271 | 1/1992 | Thacher et al. | 463/42 |
| 5,083,800 | 1/1992 | Lockton | 463/42 |
| 5,259,613 | 11/1993 | Marnell, II . | |
| 5,340,119 | 8/1994 | Goldfarb . | |

FOREIGN PATENT DOCUMENTS

| | | | |
|---|---|---|---|
| 0478412 | 4/1992 | European Pat. Off. . | |
| 2693120 | 1/1994 | France . | |
| 223592 | 1/1989 | Japan | 902/23 |
| 4222202 | 1/1994 | Japan | 902/23 |

*Primary Examiner*—Jessica Harrison
*Assistant Examiner*—Michael O'Neill
*Attorney, Agent, or Firm*—Quirk & Tratos

[57] ABSTRACT

A method by which a player may participate in a live casino game from a location remote from the casino is disclosed. A player establishes an information link with a casino from an interface station including a video monitor and keypad. In response to the player's entry of financial account information, the casino establishes an information line with the player's financial institution. The casino assigns the player to a gaming table at which a "live" game is occurring, transmitting all images of game play and instructions to the player. The player transmits bet and game play information to the casino. Because of the open line between the casino and player's financial institution, bets are checked, winnings paid, and losses debited, instantaneously.

27 Claims, 3 Drawing Sheets

METHOD OF PARTICIPATING IN A LIVE CASINO GAME FROM A REMOTE LOCATION

FIELD OF THE INVENTION

The present invention relates to a method of gambling. More particularly, the present invention is a method by which a player may participate in a live casino game from a location remote from a casino.

BACKGROUND OF THE INVENTION

Gambling is growing in popularity at a high rate. Players are interested in being able to gamble at all hours of the day and from any location.

While many states and other localities have legalized gambling, many have not. For those persons living in a state in which gambling is illegal, the person must travel out of the state to a gaming establishment in order to gamble. Obviously, this is not only inconvenient but costly.

Moreover, many people who live in states in which gambling is legal do not find it convenient to travel to a local gaming establishment to gamble. A person may be at the office or at home and wish to gamble for a short period of time.

In some instances, bets may be placed from a location remote from a casino. For example, U.S. Pat. No. 5,340,119 to Goldfarb and U.S. Pat. No. 4,592,546 to Fascenda, et al., disclose situations in which a player may place a bet from a remote location. This type of betting, along with other similar betting schemes, has several drawbacks. First, such methods do not permit a player to actively participate in a live casino game such as Blackjack or "Twenty-One." Second, when a party wins on a bet made in this manner, the party must go to a specified location to cash in the winning ticket and collect the winnings.

Presently, no convenient method exists for a person to participate in a live casino game from a location remote from the casino at which the game is being played. Furthermore, there are no existing means by which a player is able to place bets and receive winnings via instantaneously transmitted financial information between the player's personal bank account and a gaming establishment's bank account.

SUMMARY OF THE INVENTION

The present invention is a method by which a person may participate in a live casino game and place bets from a location remote from the casino at which the game is being played.

A player accesses an interface station at a location remote from a casino, such as at a home, office, tavern or similar location. The interface station includes a video display, CPU, and keypad, such as a video-phone with keypad or computer with keypad. The player establishes an information link, such by opening a telephone line, between the interface station and a CPU at a casino of choice.

Once the link between the player and casino is established, the player transmits financial account information. The casino utilizes this information to establish an open information link with the player's financial institution.

Once verification of the player's account is received, the casino assigns the player to a live table game at the casino. The table includes several player locations and a dealer at a dealer location, just as with standard casino games. The image of the game being played is transmitted to the player from one or more video cameras at the table. The table is further equipped with a video display and a keypad for use by the dealer.

A dealer opens a game by sending a "bet" signal to the player. The player enters in one or more bets which are transmitted to the casino. The casino, in turn, transmits the bet information to the player's financial institution for verification that his account contains the necessary funds. Bet verification is provided on the dealer's monitor.

Once all bets have been placed and verified, the dealer signals "no more bets," locking in the player's bets. At this time, the player can not change his bet, nor can he avoid the bet by cutting off the information link between the interface station and the casino such as by hanging up the phone or shutting off his computer. If such occurs, game play continues and the casino credits the player's account with any winnings or debits any losses.

The dealer deals the card game, preferably "Blackjack," with the player watching the deal of the cards on the video monitor. The player may elect, by pressing appropriate buttons on the keypad, to take additional cards, place additional bets, stay, or the like. Importantly, the player can see on the monitor whether he won or lost. Once the hand is complete, the dealer assesses winners and losers. The dealer presses appropriate buttons on the keypad for each player, entering the amount won or lost. If the player wins, the casino instructs the financial institution to instantaneously credit the player's account. If the player loses, the casino instructs the player's financial institution to debit the player's account and transfer the bet amount to the casino's account.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
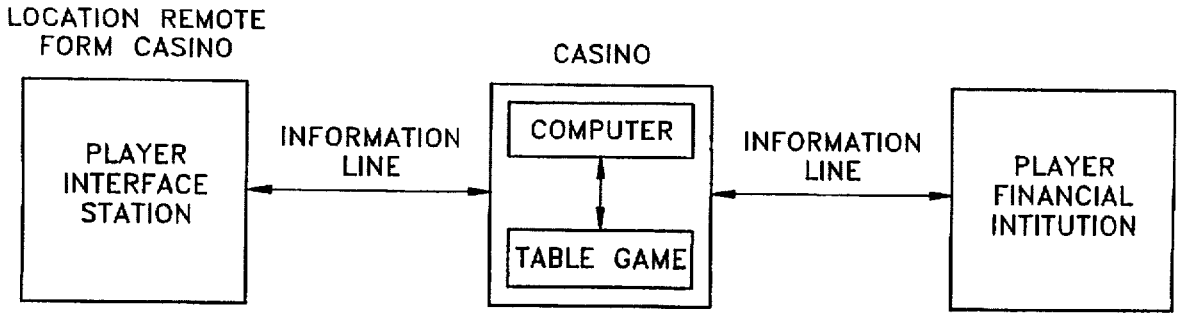
FIG. 1 is a schematic illustrating the present invention.

FIG. 1 is a schematic illustrating the method of the present invention. In general, the present invention comprises a method by which a player or gambler at a location remote from a gaming establishment may participate in a live casino game at that establishment.

The player accesses an interface station 20 (FIG. 2) at a location remote from a casino (such as at a home, office, tavern, restaurant or other location) and establishes an information line with a casino, such as by logging onto a computer and connecting to a computer at the casino via modems and a telephone line. The player provides the casino with financial account information. The casino, in turn, establishes an information line or link with the player's financial institution. Once the player's account has been verified, the casino assigns the player to a gaming table at which a live casino game is played.

The casino transmits to the player a video image of the gaming table, along with information regarding the play of the game, as controlled by the dealer. The player transmits bet and game play information back to the dealer. The casino verifies all bets with the player's financial institution.

Because of the information link between the casino and player's financial institution, the casino instantaneously debits or credits the player's account as game play occurs.

The method of the present invention and apparatus for use therewith will now be described in more detail in conjunction with FIGS. 2–6.

Figure 2:
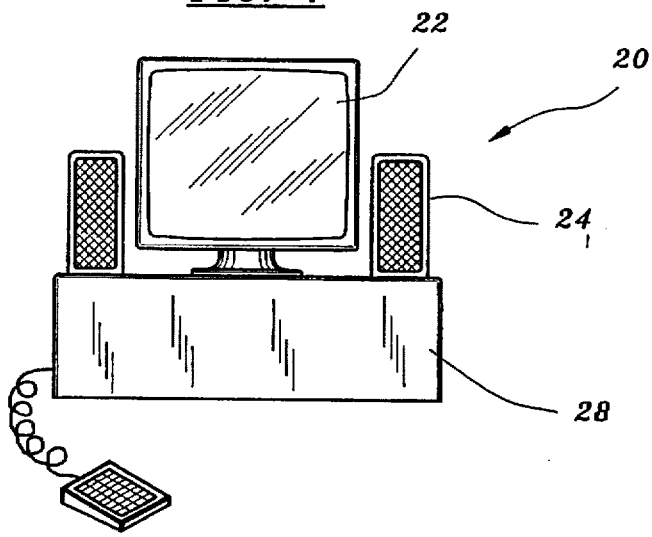
FIG. 2 illustrates an example of an interface station for use by a player in the method of the present invention.
Figure 6:
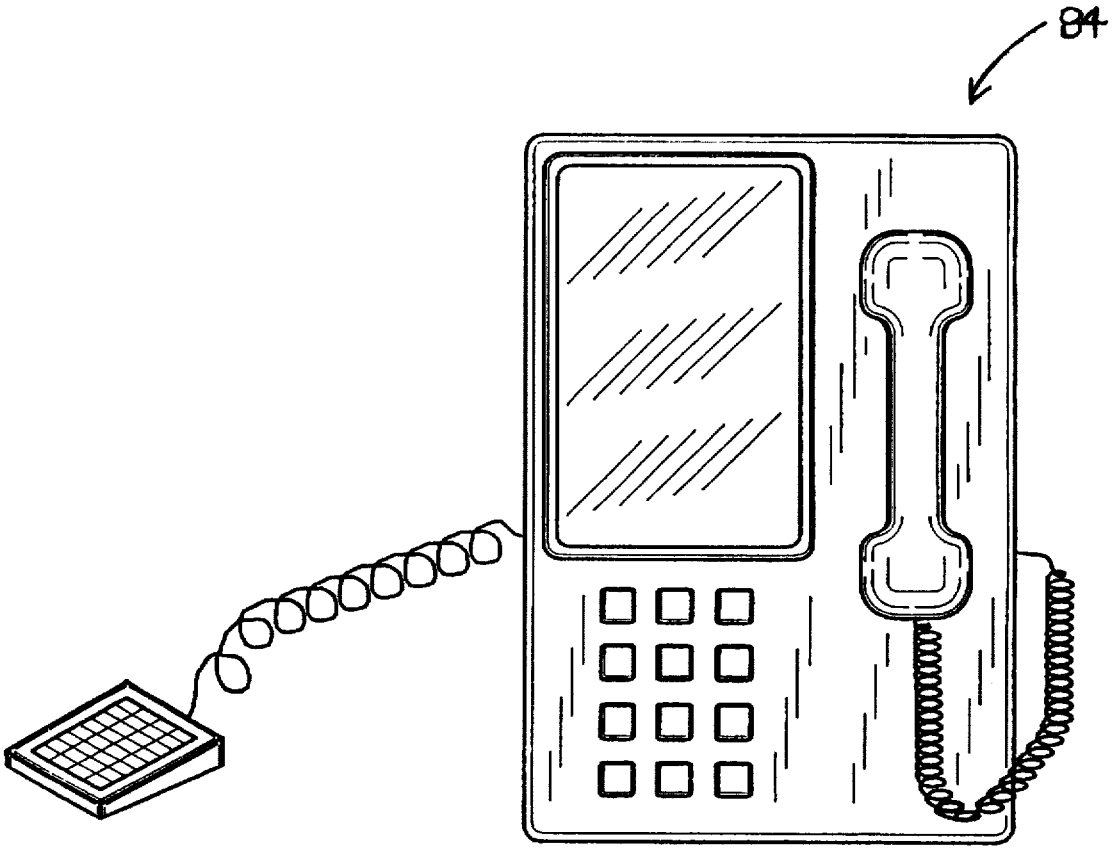
FIG. 6 illustrates a second example of an interface station for use by a player in the method of the present invention.

As illustrated in FIGS. 2 and 6, the player interface station 20 may take on several forms. Preferably, the interface station 20 includes a video monitor for viewing of a game by a player, a keypad or other means for inputting bet information, and means for transmitting and receiving information. The station 20 illustrated in FIG. 2 comprises a computer or computer-like unit having a video screen 22, audio speakers 24*a,b*, and a keypad 26, all linked to a central processing unit (CPU) 28. The interface station 20 can comprise a computer or another similar electronic apparatus such as a "video-phone" 84 which includes the above-referenced items, as illustrated in FIG. 6. This type of equipment is well known in the art.

The CPU 28 includes a modem connected to a phone line, enabling the CPU to transmit and receive information from a casino at this type of connection, including the hardware and software therefore, is well-known in the art.

Figure 3:
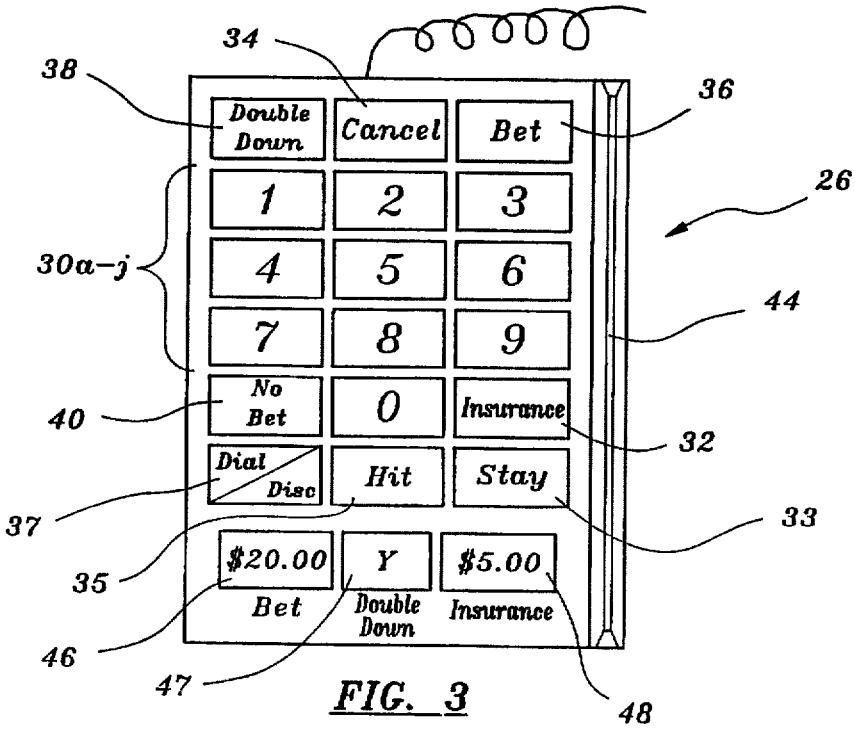
FIG. 3 illustrates a player's personalized keypad for use in playing "Blackjack" in the method of the present invention.
Figure 4:
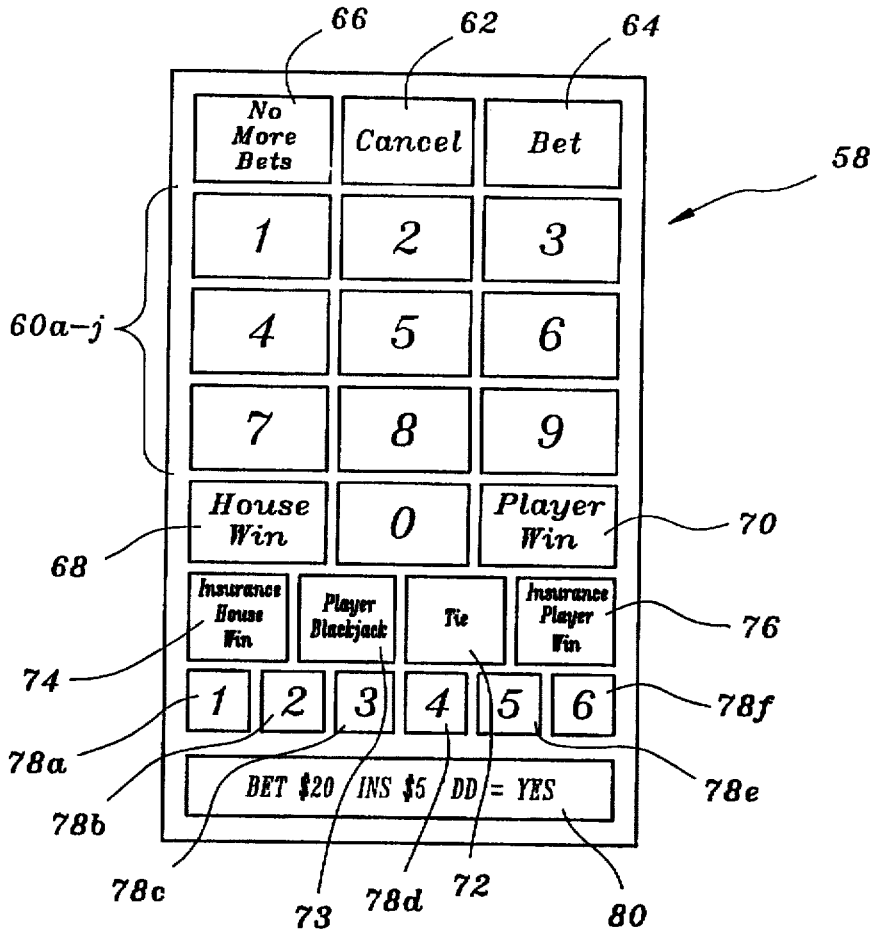
FIG. 4 illustrates a dealer's keypad.
Figure 5:
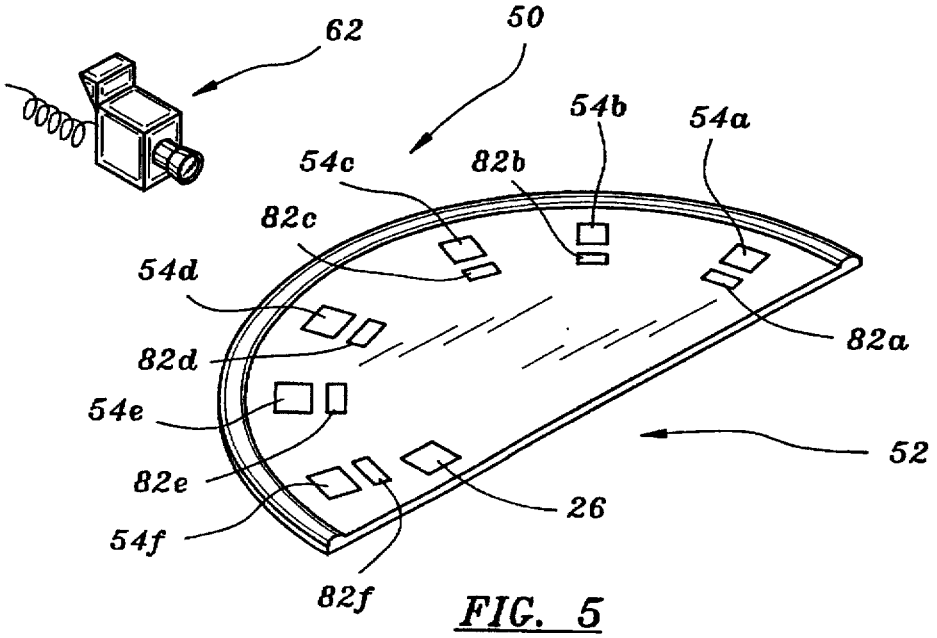
FIG. 5 is an overview of a casino table arrange for use in the method of the present invention.

The preferred embodiment player keypad 26 is illustrated in FIG. 3. This keypad 26 is uniquely designed for use in playing a remote "Blackjack" or "Twenty-One" game, although the keypad 26 could be designed in such a manner as to be useful in other specific types of games, or for use in playing any of several types of games.

The keypad 26 includes a series of touchbuttons 30*a–j* corresponding to the numbers 0–9. Touchbuttons are provided for "insurance" 32, "stay" 33, "cancel" 34, "hit" 35, "bet" 36, "dial/disconnect" 37, "double-down" 38, and "no bet" 40. Moreover, the keypad 26 includes a slide/swipe cardreader 44, and preferably, a lighted bet screen 46, double-down indicator 47, and insurance bet indicator 48. These screens and indicators 46–48 may comprise LED or LCD screens or similar displays known in the art. The descriptions of the functions of these buttons are described in detail below. The keypad 26 is small for hand-held use and coupled to the CPU 28 via a flexible cable.

At the casino, a casino CPU receives information from the player and the player's financial institution, and transmits information to the player and the player's financial institution. The casino CPU also receives information from and transmits information to a casino table 50 (See FIG. 5) located at the casino.

The casino table 50 is similar to a standard casino table at which players are physically present. In particular, the table 50 includes a dealer location 52 and several player locations 54*a–f*. In order for the dealer to "communicate" with the players, the dealer is provided with a dealer keypad 58 (See also FIG. 4). Bet information corresponding to each player, which is visible to all other players, is displayed on the table 50. A display screen 82*a–f* is preferably located on the table at each player location 54*a–f*. The display screen 82*a–f* may be of LCD/LED or a similar type.

Further, at least one video camera 62 or similar device is located above the table 50 for transmitting the image of the table and the dealt cards to the players. The video camera 62 may be equipped with a microphone for transmitting an audio signal, such as oral dealer instructions, to the players.

The dealer uses the dealer keypad 58 (See FIG. 4) to control the play of the game, including taking bets, closing bets, collecting losing bets, and awarding winning payouts. Preferably, the dealer keypad 58 includes touchbuttons 60*a–j* corresponding to the numerals 0–9, for "cancel" 62, "bet" 64, "no more bets" 66, "housewin" 68, "player win" 70, "tie" 72, "player blackjack" 73, "insurance house win" 74, "player insurance win" 76, a button corresponding to each player 78*a–f*, and a bet information display screen 80. The dealer keypad 58 and the video monitor 60 are interconnected with the casino CPU.

The casino CPU includes a modem or other means for establishing an information link with both the player and the player's bank or other financial institution. The hardware and software for accomplishing such is known in the art.

In operation, play in accordance with the method of the present invention is as follows.

First, a player accesses an interface station 20, such as at his home, office, or other location remote from the casino at which he wishes to participate in a live game. The player turns on the station which prompts the entry of a phone number. The player enters the access phone number for the particular casino at which he wishes to play, punching the appropriate buttons 30*a–j* on the keypad 26. The player then presses the dial button 37, triggering the CPU 28 to dial up the casino CPU. The activity establishes an information line or link between the casino and the player.

Once this player/casino information line is established, the casino CPU sends a request, displayed on the video monitor 22 at the player interface station 20, instructing the player to pass a credit/debit card through the card reader 44 at the player keypad 26.

The player then swipes his card through the cardreader 44. The interface station 20 CPU transmits the financial institution account data to the casino CPU. In response, the casino CPU establishes an information line with the financial institution at which the account is located. In particular, the casino CPU, using stored data, dials up the particular financial institution at which the account is located.

Once the information link with the financial institution is established, the casino CPU assigns the player to an open spot at one of the tables 52 at the casino. At this time, the player begins receiving the video (and optionally, audio) signal from the table 52.

If the player is assigned to a table 52 during the middle of an on-going game, the player will receive a "no bets" instruction as previously entered by the dealer at his keypad 58, on the video screen 22.

Once an ongoing game is completed, or when the player is assigned to a table between games, the player will receive a "bet" signal. In particular, at the completion of a game, the dealer presses the "bets" button 64 on the dealer keypad 58. When the dealer depresses this button 64, the casino CPU clears all prior bet information from the dealer's monitor 60, and at the same time causes a "bet" signal to appear on the video screen 22 at each player station 20.

Once the "bet" signal appears, the player places a bet. In particular, the player enters in the dollar amount of the bet he wishes to place using the numerical buttons 30*a–j* on the player keypad 26. The player then presses the "bet" button on the keypad 26, sending the bet information to the casino. The player uses the "cancel" button 34 to correct incorrect entries.

If the player does not wish to participate in that particular game, the player can depress the "no bet" button 40 to indicate that fact. A "no bet" indicator is then indicated on the dealer's display 80 when the appropriate player button 78*a–f* is pressed.

Once the bet information is received by the casino CPU, the casino CPU transmits that information to the player's financial institution over the open line therebetween, where a CPU at that institution verifies that the player's account contains a balance greater than the bet. If it does, the bank CPU verifies the bet to the casino, and the casino CPU transmits the amount bet to the dealer where the amount of the bet appears on the display 80 when the dealer presses the button 78*a–f* corresponding to that player. At the same time, the bet is displayed on the bet screen 46 on the player's keypad. If the bet is not verified, the casino CPU sends a message to the player, who may then place a different, smaller bet.

After sufficient time has passed for all bets to be placed and verified, the dealer depresses the "no more bets" button 58. This causes a "no more bets" indication to be transmitted to each player. Preferably, this indicator blinks for approximately 5–15 seconds, and then becomes solid. During the "blinking" phase, the player may change his bet, including cancelling it by depressing the "cancel" button 34. Most importantly, once the "no more bets" indicator becomes solid, the casino CPU will not allow the player to alter his bet.

Thus, once the betting phase is closed, the player may not change or remove the bet. If the player remains logged on, but attempts to change the bet, the bet will not change. If the player "disconnects" or is disconnected, play of the game continues and amounts won are still credited to the player and amounts lost are debited from the player's account and credited to the casino.

Such protects the casino from a player deciding he wishes to avoid his bet after game play begins. Then, if the player shuts off his computer, hangs up the phone/phone-line, the player's bet is not lost. This also protects the player. In the event of a bad phone line or similar problem which results in a disconnection, the player's bet is not automatically connected. Instead, in either case, play continues until the player wins or loses, in which event the player's account is credited or debited, as appropriate.

Once all bets are placed, the dealer begins dealing the cards. The dealer depresses the first player button 78*a* to determine if that player has placed a bet, and if so, deals that player a card(s). The dealer then depresses the next player button 78*b* and so on. The game preferably played in accordance with the method of the present invention is "Blackjack."

If the dealer's face-up card is an "ace," the player may depress the "insurance" button 32. When depressed, this button 32 causes the CPU 28 to send insurance bet information to the casino and displays the bet on the indicator 48 on the player's keypad 26. The casino calculates the insurance bet (normally half the original bet) and transmits the bet information to the player's financial institution. Once the player's financial institution confirms sufficient funds are in the player's account, the casino CPU indicates that fact on the dealer's monitor.

At this time, players preferably also have the opportunity to "double-down" as is well known in the art. If the player wishes to place this bet, he depresses the corresponding button 38 on the keypad 26, causing the double-down indicator 47 to light up. Again, this triggers the CPU 28 to send information to the casino about the bet, which the casino verifies with the player's financial institution.

Once all bets are placed, each player elects to "stay" or "hit." If the player wishes to "stay" or "hold," the player depresses that button 33 on the player keypad 26. If the player wishes to take an additional card or cards, he depresses the "hit" button 35, causing a signal to appear in the dealer's display 80.

Again, the player can track the play of the game and view each of the cards on the table 52 by watching the video monitor 22 at his station 20. In addition, the player can see each bet placed by the other players as displayed on the screens 82*a–f* on the table 50.

Once all players have been dealt all their cards, the dealer closes out the hand determining the winning and losing bets in accordance with standard game play.

The dealer works around the table 52, first depressing the player button 78*a–f* corresponding to that player. If the player won the game, the dealer enters in the winning payout with the numerical keybuttons 60*a–j*, and then depresses the "player win" button 70. If an insurance bet was placed and won by the player, the dealer also depresses the "insurance player win" button 76. If the player won with a "Blackjack" the dealer depresses the player Blackjack button 73. The dealer uses the "cancel" button 62 to correct incorrect entries.

In response to a "player win" or "player insurance win" entry, the casino CPU transmits information to the financial institution instructing the institution to instantly credit the player's account with the proper winnings from the casino's account.

If the player lost the bets, after the dealer depresses the correct player button 78*a–f*, the dealer depresses the "house win" and "insurance house win" (if applicable) buttons 68,74. In response, the casino CPU instructs the bank to immediately debit the player's account and credit the casino's account.

Upon completion of all bet credits and debits, the dealer depresses the "bets" button 64 again, clearly the player information displayed on his video monitor 60 and indicating to all players that bets on the next game are now being taken.

A player may disconnect from a game at any time by depressing the "dial/disconnect" button 37. If, as stated above, the player disconnects during game play, all bets placed by the player are automatically credited from the player's account to the casino's account. A player may disconnect without penalty, however, at any time between games.

The method of the present invention solves many of the "security problems" associated with prior methods of game play. Further, the present method eliminates the inconveniences associated with other attempts to allow a player to place bets and participate in casino games from remote locations.

First, the via the casino CPU the casino can record all bets placed and all winnings paid. Moreover, the casino can record the game play from the video camera to review whether winning and losing hands were properly credited. The method of the present is particularly advantageous to casinos because the players are not physically present at the table, eliminating the risk that a player is tampering with the cards or bets during the game.

Moreover, even though the player is remote from the casino, the casino can ensure payment of the bet placed by the player via the information link with the appropriate financial institution. The player also can not attempt to "remove" his bet by disconnecting during the middle of a game which the player believes he will lose.

From the player's perspective, the method of the present invention has numerous advantages as well. First, the player can participate in a "live" casino game from any location where an interface station 20 can be found. Thus, a player may play from work, home, or any other location. This eliminates the need for the player to travel, no matter how far, to the casino to gamble.

As with a standard live casino game, the player is also immediately credited with winnings. Thus, as opposed to all other methods of play, the player need not travel to a casino cage or some other designated "payoff" location in order to collect winnings.

This last feature benefits both casinos and players. In particular, without the "open" circuit which both debits and credits the player's financial account during play, the player would often be forced to stop playing. In particular, if the player's account is only debited, soon that player's account would be empty, preventing him from participating in any more games. Only by "cashing in" winning hands, and then sending the winnings to the player's financial institution for crediting to his account could the player continue to play against his credit line. This process could take days, preventing the player from playing during that time.

In the present method, winnings are constantly credited to the player's account, so that (barring extensive losses as against winnings) the player can continue to play for a much longer period of time.

Many variations of the above-referenced apparatus are contemplated for use in the present invention. For example, the keypads 26,58 which the players and dealer use can comprise either standard keyboards or phone keys which are configured (such as by use of special software) to have keys which trigger the above-referenced events. Alternatively, the keypads 26,58 can be eliminated and replaced with a video "touchscreen."

A player may also incorporate his home television into the station 20, eliminating the need for a separate video screen.

The dealer may also be provided with a separate monitor or screen on which all player bet and other information is displayed.

To ensure that the player is not utilizing another's credit/debit card, the system may be set up to require the entry of the player's "PIN" number associated with his credit/debit card before the financial account may be accessed.

To eliminate the need for the dealer to calculate winning payouts, the casino CPU can be programmed to do the same automatically. For example, the casino CPU, having stored all bet information, can be instructed, such as when the dealer simply depresses the "player win" button 70, to pay the player the appropriate amount.

The above description has been specifically described in conjunction with play of "Blackjack" and of a specific version thereof including insurance and double-down bets. It is contemplated that the method be used with any version of the game as preferred by the casino. For example, the particular casino may not allow "double-down" bets, but may allow "splitting" of pairs as is known. In that instance, appropriate instructions may be sent to the player during game play indicating when such bets are available, if at all.

In order to facilitate smooth game play, or play by beginners, the casino may transmit casino rules to each player after he connects with the casino. Further, instructions may be transmitted to the player throughout the game.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A method for a player to remotely participating in a live casino game comprising:

(i) establishing a first information line between a player at an interface station located remotely from the casino for the transmission of live television signals and data signals to a player interface station located remote from the casino, said interface station including a player display to display a live television image of a live game to the player;

(ii) from said interface station, the player transmitting over said first information line to the casino account information related to an account maintained by the player at a third party financial institution;

(iii) the casino opening a second information line with the third party financial institution in response to receipt of said account information;

(iv) maintaining said second information line open with the first information line;

(v) the casino transmitting over the first information line data indicative that the player can make a bet;

(vi) the player from their interface station transmitting over the first information line to the casino bet information indicating a bet being made by the player on the live game;

(vii) in response to the transmitted bet, the casino over the second information line verifying the status of the player's account, the casino accepting the bet if the player's account has sufficient funds and otherwise denying the bet;

(viii) the casino transmitting data over the first information line data indicative that no more bets can be made, said data displayed at the display with the television signal;

(ix) the player over the first information line interacting with the casino to control the play of the game until an outcome is obtained;

(x) determining from the outcome whether the player's bet is won or lost, said player viewing the live play of the game at the display to confirm the outcome;

(xi) in the event of interruption of said first information line, said casino completing the play of the game to determine the outcome pertaining to the player's wager; and (xii) the casino issuing instructions over the second information line to credit the player's account if the player has won the bet in the amount of the bet and the player's winnings and to debit the player's account if the player's bet is lost.

2. The method of claim 1 wherein the game is a live action table game, the method further including assigning the player to a position at the table.

3. The method of claim 1 further including a casino dealer dealing the game using a data input device to issue data signals over the first information line to the interface station, said interface station in response to said data displaying information simultaneously with said live television signals to control the players play of the game.

4. The method of claim 3 including the dealer inputting data to cause the display to display information (i) to indicate that the player can now make a bet and (ii) to indicate that the player cannot now make a bet.

5. The method of claim 3 including the dealer using the input device to issue signals to indicate the final result of the game, the interface station in response to the data signals displaying information to the player that the player has won or lost.

6. The method of claim 5 including the dealer inputting data causing the display to display information that (i) the player has won, (ii) the player has lost or (iii) the game has resulted in an outcome that is neither a win or a loss.

7. The method of claim 6 including causing the display to display with the television signal where applicable (i) "player win", (ii) "house win" or (iii) "tie".

8. The method of claim 3 wherein the game is a live game of Blackjack, the dealer inputting data causing the display to display information to control the play of the hand.

9. The method of claim 8 including causing the display to display information prompting whether the player wishes to take insurance.

10. The method of claim 1 further including providing a casino display associated with each player, said casino display displaying information transmitted by the player over the first information line to the casino.

11. The method of claim 10 including providing the casino screen for each player in a position whereby the display of each player is televised to the other players in said television image.

12. The method of claim 11 including displaying at the casino display information indicating the amount of the player's bet.

13. The method of claim 1 further including recording the television signals of the play of the game.

14. A method for a player to remotely participating in a live casino game operated by a dealer at a table having thereat a plurality of player positions comprising:

(i) establishing a first information line between each player at an interface station located remotely from the casino for the transmission of live television signals and data signals to each player interface station located remote from the casino, said interface station including a player display to display a live television image of a live game to the player;

(ii) from said interface station, the player transmitting over said first information line to the casino account information related to an account maintained by the player at a third party financial institution;

(iii) the casino opening a second information line with the third party financial institution in response to receipt of said account information and verifying the existence of the player's account;

(iv) maintaining said second information line open with the first information line;

(v) assigning each player having opened the first information line and had whose account has been verified to a discrete position at the table;

(vi) the casino transmitting over the first information line data signals causing each player display to display with the live television image of the game information that each player can now make a bet;

(vii) each player from their interface station transmitting over the first information line to the casino bet information indicating a bet being made by the player on the live game;

(viii) in response to the transmitted bet, the casino over the second information line verifying the status of the player's account, the casino accepting the bet if the player's account has sufficient funds and otherwise denying the bet;

(ix) the casino transmitting data over the first information line data signals causing each player display to display information with the live television signal indicative that no more bets can be made;

(x) the player over the first information line interacting with the casino to control the play of the game until an outcome is obtained;

(xi) determining from the outcome whether each player's bet is won or lost, each player viewing the play of the game at the display to confirm the outcome;

(xii) in the event of interruption of said first information line, said casino completing the play of the game to determine the outcome pertaining to the player's wager and maintaining the second information line in an open condition for resolution of the player's wager; and (xiii) the casino issuing instructions over the second information line to credit the player's account if the player has won the bet in the amount of the bet and the player's winnings and to debit the player's account if the player's bet is lost.

15. The method of claim 14 further including providing a casino display at each player station, said player's bets transmitted over the first information line operating each player's display to display the amount of the bet.

16. The method of claim 15 further including positioning said casino displays to be within the televised image of the game for the players to see the bets by other players.

17. The method of claim 14 further including the dealer using a data input device to issue data signals over the first information line to the interface station, said interface station in response to said data displaying information to control the players play of the game.

18. The method of claim 14 including recording the television signals of the play of the game.

19. A method for a player to remotely participating in a live casino game operated by a dealer at a table having thereat a plurality of player positions comprising:

(i) establishing a first information line between each player at an interface station located remotely from the casino for the transmission of live television signals and data signals to each player interface station located remote from the casino, said interface station including a player display to display a live television image of a live game to the player;

(ii) from said interface station, the player transmitting over said first information line to the casino account information related to an account maintained by the player at a third party financial institution;

(iii) the casino opening a second information line with the third party financial institution in response to receipt of said account information and verifying the existence of the player's account;

(iv) maintaining said second information line open as long as the first information line is open;

(v) assigning each player having opened the first information line and had whose account has been verified to a discrete position at the table;

(vi) the casino transmitting over the first information line data signals causing each player display to display with the live television image of the game information that each player can now make a bet;

(vii) each player from their interface station transmitting over the first information line to the casino bet information indicating a bet being made by the player on the live game;

(viii) in response to the transmitted bet, the casino over the second information line verifying the status of the player's account, the casino accepting the bet if the player's account has sufficient funds and otherwise denying the bet;

(ix) providing a casino display for each player position to display the amount of the bet being made by each player, said display positioned for the dealer and other players to see;

(x) the casino transmitting data over the first information line data signals causing each player display to display information with the live television signal indicative that no more bets can be made;

(xi) the player over the first information line transmitting information to the casino to control the play of the game to obtain an outcome;

(xii) determining from the outcome whether each player's bet is won or lost, each player viewing the play of the game at the display to confirm the outcome;

(xiii) in the event of interruption of said first information line, said casino completing the play of the game to determine the outcome pertaining to the player's wager and maintaining the second information line in an open condition for resolution of the player's wager;

(xiv) recording the television signals for verification of the play of the game; and (xv) the casino issuing instructions over the second information line to credit the player's account if the player has won the bet in the amount of the bet and the player's winnings and to debit the player's account if the player's bet is lost.

20. A method for a player to remotely participating in a live casino game of Blackjack dealt by a dealer at a table having thereat a plurality of player positions comprising:

(i) establishing a first information line between each player at an interface station located remotely from the casino for the transmission of live television signals and data signals to each player interface station located remote from the casino, said interface station including a player display to display a live television image of a live game to the player;

(ii) from said interface station, the player transmitting over said first information line to the casino account information related to an account maintained by the player at a third party financial institution;

(iii) the casino opening a second information line with the third party financial institution in response to receipt of said account information and confirming the existence of the player's account;

(iv) maintaining said second information line open as long as the first information line is open;

(v) assigning each player having opened the first information line and whose account has been confirmed to an individual position at the table;

(vi) the casino transmitting over the first information line data signals causing each player display to display, with the live television image of the game, information that each player can now make a bet;

(vii) each player from their interface station transmitting over the first information line to the casino bet information indicating a bet being made by the player on the live game;

(viii) in response to the transmitted bet, the casino over the second information line verifying the status of the player's account, the casino accepting the bet if the player's account has sufficient funds and otherwise denying the bet;

(ix) providing a casino display for each player position to display the amount of the bet being made by each player, said display positioned for the dealer and other players to see;

(x) the casino transmitting data over the first information line data signals causing each player display to display information with the live television signal indicative that no more bets can be made;

(xi) determining during play of the live game whether each player's bet is won or lost, each player viewing the play of the game at the display to confirm the outcome;

(xii) in the event of interruption of said first information line, said dealer completing the play of the game to determine the outcome pertaining to the player's wager, the casino maintaining the second information line in an open condition for resolution of the player's wager; and (xiii) the casino issuing instructions over the second information line to credit the player's account if the player has won the bet in the amount of the bet and the player's winnings and to debit the player's account if the player's bet is lost.

21. The method of claim 20 further including the dealer using a data input device to issue data signals over the first information line to the interface station, said interface station in response to said data displaying information to control the players play of the game.

22. The method of claim 21 including the dealer inputting data to cause the display to display information (i) to indicate that the player can now make a bet and (ii) to indicate that the player cannot now make a bet.

23. The method of claim 22 including the dealer using the input device to issue signals to indicate the final result of the game, the interface station in response to the data signals displaying information to the player that the player has won or lost.

24. The method of claim 21 including the dealer inputting data causing the display to display information that (i) the player has won, (ii) the player has lost or (iii) the game has resulted in a tie.

25. The method of claim 23 including causing the display to display with the television signal where applicable (i) "player win", (ii) "house win" or (iii) "tie".

26. The method of claim 21 including causing the display to display information prompting whether the player wishes to take insurance or double down.

27. The method of claim 20 further including recording the television signals for future reference.

* * * * *